US008448336B2

(12) United States Patent
Barcelo et al.

(10) Patent No.: US 8,448,336 B2
(45) Date of Patent: May 28, 2013

(54) ELECTROPHOTOGRAPHIC ROLLER WITH RESISTANCE TO NIP BANDING

(75) Inventors: Jane Elece Barcelo, Wilmore, KY (US); Bradley Leonard Beach, Lexington, KY (US); Liam Ruan De Paor, Lexington, KY (US); Mark Duane Foster, Lexington, KY (US); Terence Edward Franey, Lexington, KY (US); Bhaskar Gopalanarayanan, Lexington, KY (US); Kevin Scott Kennedy, Lexington, KY (US); Kelly Ann Killeen, Lexington, KY (US); Chao Li, Lexington, KY (US); Jean Marie Massie, Lexington, KY (US); Ronald Lloyd Roe, Lexington, KY (US); Richard Nicholas Schrantz, Jr., Nicholasville, KY (US); Scott Alan Searls, Richmond, KY (US); Robert Francis Soto, Lexington, KY (US); Donald Wayne Stafford, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1334 days.

(21) Appl. No.: 12/167,601

(22) Filed: Jul. 3, 2008

(65) Prior Publication Data

US 2010/0003610 A1 Jan. 7, 2010

(51) Int. Cl.

| | |
|---|---|
| ***B21K 1/02*** | (2006.01) |
| ***B05C 1/08*** | (2006.01) |
| ***G03G 15/08*** | (2006.01) |

(52) U.S. Cl.

USPC ..... 29/895.32; 29/895.211; 29/895.3; 29/895; 492/56; 492/53; 492/48; 492/38; 492/18; 399/286

(58) Field of Classification Search

USPC ..... 492/17, 18, 38, 56, 59, 48, 53; 29/895.32, 29/895, 895.2, 895.21, 895.211, 895.3; 399/115, 399/116, 122, 286

See application file for complete search history.

(56) References Cited

U.S. PATENT DOCUMENTS

| | | | | |
|---|---|---|---|---|
| 5,324,613 | A * | 6/1994 | Ciccarelli et al. | 430/108.3 |
| 5,707,743 | A | 1/1998 | Janes et al. | |
| 5,804,114 | A | 9/1998 | Janes et al. | |
| 5,874,172 | A | 2/1999 | Beach et al. | |
| 5,925,893 | A * | 7/1999 | Ishii et al. | 257/40 |
| 6,042,946 | A | 3/2000 | Massie, II et al. | |
| 6,150,025 | A | 11/2000 | Roe et al. | |
| 6,393,249 | B1 * | 5/2002 | Aslam et al. | 399/333 |
| 6,458,165 | B1 * | 10/2002 | Foucher et al. | 359/296 |
| 6,534,180 | B2 * | 3/2003 | Hoshi | 428/413 |
| 6,687,476 | B2 * | 2/2004 | Goseki et al. | 399/109 |
| 7,280,779 | B2 | 10/2007 | Fasen | |
| 7,307,112 | B2 * | 12/2007 | Swift et al. | 524/79 |
| 7,603,067 | B2 * | 10/2009 | Mizumoto | 399/286 |

* cited by examiner

*Primary Examiner* — Sarang Afzali

(57) ABSTRACT

An endless electrophotographic member, such as a developer roller, which indicates an improved resistance to nip banding. The improvement to nip banding may be provided by the use of an organic salt within a roller surface region. The roller may provide, at a nip location, a resistive surface layer having an electrical resistance that avoids the development of nip banding and relatively dark regions on printed media.

34 Claims, 5 Drawing Sheets

| Depth (μm) From Surface | Depth (μm) From Surface | Zn Concentration ppm | ZnDTBSA Concentration ppm |
|---|---|---|---|
| 0 | 100 | 4411 | 38051 |
| 100 | 200 | 778 | 6711 |
| 200 | 300 | 629 | 5426 |

FIG. 2

ELECTROPHOTOGRAPHIC ROLLER WITH RESISTANCE TO NIP BANDING

REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to an electrophotographic roller, such as a developer roller including a resistive layer over a semi-conductive core. The roller incorporates organic salts to improve electrical surface resistance and/or overall printing performance, such as resistance to printing defects caused by nip banding.

2. Description of the Related Art

During the image forming process, image forming material, such as toner, may be transferred from toner carrying members (rollers) to print or copy media. For example, a developer roller, which transfers toner to a photoconductive (PC) surface, may be configured with a surface layer of relatively high electrical resistance over a semi-conductive core, which may then provide improved toner transfer and print performance. Such a surface layer may specifically be the result of forming a roller with a diene type polymer (e.g. polybutadiene) in the presence of an inorganic salt and heating/baking in the presence of oxygen to provide an oxidized surface layer. A resistive layer may be formed in this manner having a thickness of about 100 microns from the surface.

With the ever increasing market demands for faster print speeds and improved print quality, the above referenced rollers containing an oxidized surface have nonetheless led to the development of various other printing problems. For example, a typical developer roller may form a nip with a doctor blade and/or a toner adder roller and/or photoconductive drum and/or with a particular cartridge sealing location. Over time, this may lead to what is termed "nip banding", the practical effect of which is the formation of relatively dark regions on the printed media. Such nip banding also may adversely influence roller electrical properties and therefore may decrease the life of a given printer cartridge. Such nip banding may also be particularly problematic when a printer cartridge experiences a change from a relatively high humidity environment (e.g. greater than 78° F./80% relative humidity) to a relatively low humidity environment (e.g., less than or equal to 60° F./8.0% relative humidity).

SUMMARY OF THE INVENTION

In a first exemplary embodiment, the present disclosure relates to an endless electrophotographic member comprising a polyurethane containing a polydiene, an electrically conductive filler, including a core and an outer surface containing an oxidized polydiene providing a resistive surface layer. The surface includes an organic salt diffused into the resistive surface layer and the member includes a nip location, and the nip location has a surface resistivity of $5\times10^9$ ohm-cm to $2\times10^{12}$ ohm-cm at 60° F. and 20% relative humidity.

In a second exemplary embodiment, the present disclosure relates to an endless electrophotographic member comprising a polyurethane containing a polydiene, an electrically conductive filler, including a core and an outer surface containing an oxidized polydiene providing a resistive surface layer. The member includes an organic salt dispersed through-out and the member includes a nip location, and the nip location has a surface resistivity of $5\times10^9$ ohm-cm to $2\times10^{12}$ ohm-cm at 60° F. and 20% relative humidity.

In a third exemplary embodiment, the present disclosure relates to a method for forming an endless electrophotographic member which comprises supplying a polyurethane containing a polydiene, an electrically conductive filler, including a core and an outer surface containing an oxidized polydiene providing a resistive surface layer, wherein said outer surface includes a nip location. This may then be followed by exposing the surface to an organic salt, wherein the member indicates, at said nip location, a resistive surface layer of between $5\times10^9$-$2\times10^{12}$ ohm-cm at 60° F. and 20% relative humidity.

In a fourth exemplary embodiment, the present disclosure relates to a method for forming an endless electrophotographic member comprising forming a polyurethane containing a polydiene in the presence of an electrically conductive filler and an organic salt, wherein the member includes a core and an outer surface. This is followed by heating to form an oxidized polydiene outer surface having a resistive surface layer and wherein said outer surface includes a nip location. The member then indicates, at said nip location, a resistive surface layer of between $5\times10^9$-$2\times10^{12}$ ohm-cm at 60° F. and 20% relative humidity.

In a fifth exemplary embodiment, the present disclosure relates to an endless electrophotographic member comprising a polyurethane containing a polydiene, an electrically conductive filler, including a core and an outer surface containing an oxidized polydiene providing a resistive surface layer. The member includes an organic salt dispersed throughout and the member further includes an organic salt diffused into the resistive surface layer from the outer surface wherein the member includes a nip location, and the nip location has a surface resistivity of $5\times10^9$ ohm-cm to $2\times10^{12}$ ohm-cm at 60° F. and 20% relative humidity.

In a sixth exemplary embodiment, the present disclosure relates to a method for forming an endless electrophotographic member which comprises forming a polyurethane containing a polydiene in the presence of an electrically conductive filler and an organic salt, wherein the member includes a core and an outer surface. This is followed by heating to form an oxidized polydiene outer surface having a resistive surface layer and wherein said outer surface includes a nip location, and wherein the organic salt may be dispersed though-out the member. This may then be followed by exposing the surface layer to an organic salt, wherein the organic salt diffused from the outer surface of the member and into the member, wherein the member has, at the nip location, a resistive surface layer of between $5\times10^9$ ohm-cm to $2\times10^{12}$ ohm-cm at 60° F. and 20% relative humidity.

In a seventh exemplary embodiment, the present disclosure relates to a method for forming an endless electrophotographic member which comprises forming a polyurethane containing a polydiene in the presence of an electrically conductive filler and an organic salt, wherein the member includes a core and an outer surface. This may then be followed by exposing the surface layer to an organic salt, wherein the organic salt diffuses from the outer surface of the member and into the member. This may then be followed by heating to form an oxidized polydiene outer surface having a resistive surface layer and wherein said outer surface includes a nip location, and wherein the organic salt may be dispersed though-out the member. The member has, at the nip location, a resistive surface layer of between $5\times10^9$ ohm-cm to $2\times10^{12}$ ohm-cm at 60° F. and 20% relative humidity.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 2 provides a table showing the use of zinc-3,5-di-tert-butylsalicylate in a number of electrophotographic members (developer rollers), containing a polydiene resistive surface layer, indicating the levels of Zn that may be found in the indicated layers;

DETAILED DESCRIPTION

Figure 1:
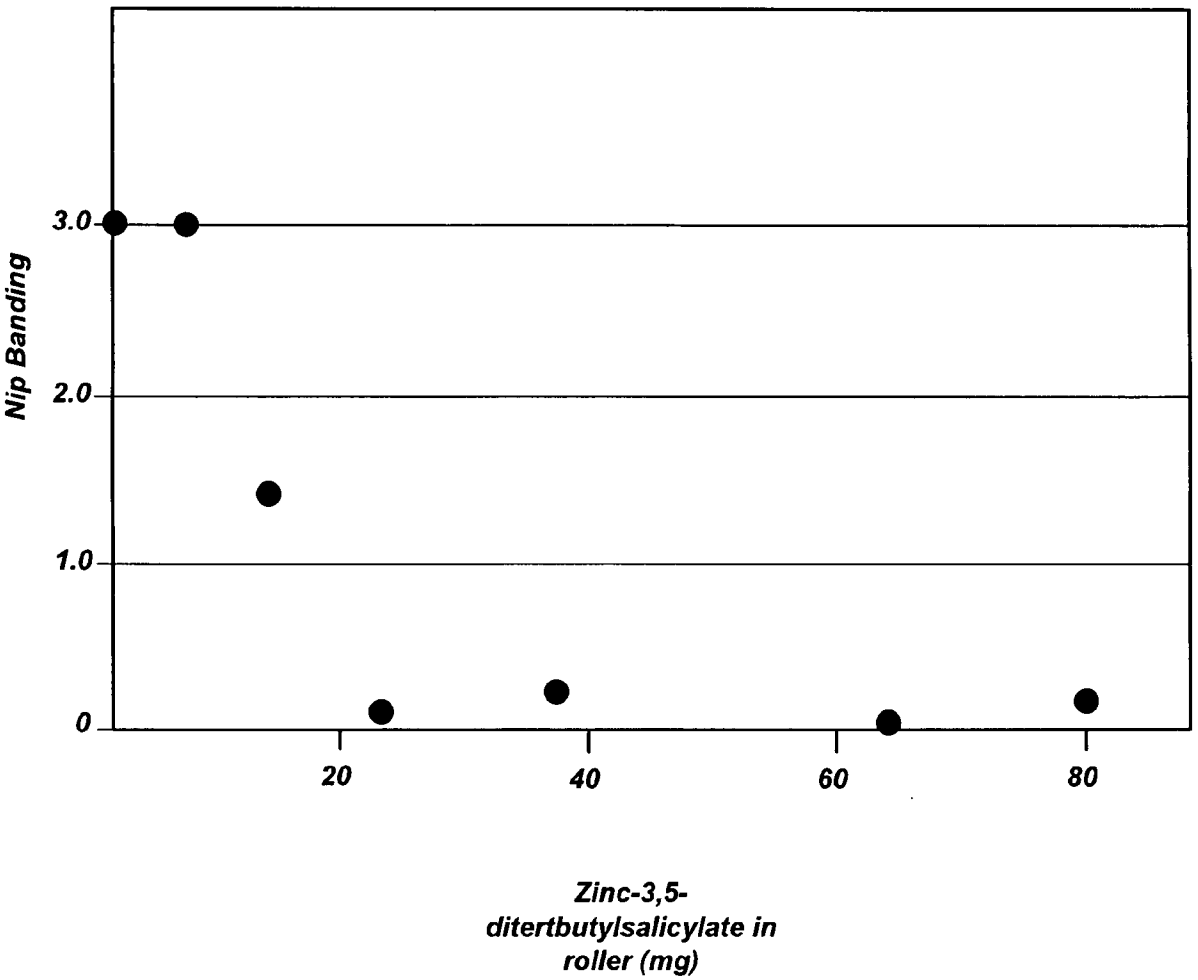
FIG. 1 is a graph illustrating the use of the indicated amounts of zinc complex (zinc-3,5-di-tert-butylsalicylate) in a developer roller and corresponding nip banding performance.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In electrophotography, the developer roller function is to develop a layer of toner on a photoconductor drum charged in an image pattern. Electrical models of this process have been well reported in the literature. Equations for the development curve, which relates the developed mass of toner per unit area to the development potential, have been derived for several developer roll constructions. See, e.g., U.S. Pat. No. 5,707,743 whose teachings are incorporated by reference. The development equations for a semi-conductive roller ($1\times10^7$-$1\times10^9$ ohm-cm resistivity) and a semi-conductive roller with a high resistance coating have been compared. The electrical model developed by H. Tachibana (Conference Record IEEE IAS 1989, p. 2260, "Control of Toner Reproduction Characteristics by Time Constant of Development Roller in Mono-Component Development") can be used to evaluate the print performance of these rolls for different print speeds, roller electrical properties, and other variations.

Results indicate that a two layer, "coated" roller will develop a fixed quantity of toner per volt of development bias that is determined by the dielectric thicknesses of the photoconductor, the toner and the developer roller. This development characteristic is independent of process speed, within limits. In contrast, a solid roll of a single resistivity develops a quantity of toner based on the dielectric constants of the photoconductor and the toner, and the resistance of the roll in the photoconductor nip. This is dependent on process speed. In addition, a two-layer roll has a longer time constant than a solid roll. Longer time constant materials leave a higher effective development surface potential on the developer roll at the entry to the photoconductor nip. This improves the single pel dot print performance of the roll.

One available technique to produce a semi-conductive roll with a resistive layer is to prepare a core using any standard rubber molding technique, such as casting liquid urethanes or rubber transfer molding. The core is then ground to the correct dimensions and either spray or dip coated with a resistive material to the desired thickness. The coating is usually applied in several layers to build up to the desired thickness of 100 microns. Problems with this process include its relatively higher cost due to the multiple coating steps and the defects introduced into the surface layer during the coating process.

Using the combination of materials described in this specification, a resistive surface layer may be produced on a roller that contains a polydiene type polymer in the presence of a conductive filler such as conductive metal salt. In addition, an organic salt is now included that, as more fully discussed below, may be capable of maintaining a desired level of electrical resistivity while reducing the tendency to create nip banding and undesirable shifts in the toner density on printed media. In addition, such organic salt additive may be particularly useful in those environments that may tend to alter the moisture content of the roller.

As alluded to above, the rollers herein may first include a polydiene component. This may be understood as any polymer containing some amount of residual double bonds in the polymeric chain. For example, the polydiene may be a polybutadiene have the following general structure:

$$*\text{-}[CH_2\text{—}CH\text{=}CH\text{—}CH_2]_n\text{-}*$$

In the above, the polybutadiene may be present in trans-1,4 and/or cis-1,4 configuration, along with the presence of 1,2-vinyl structure, as illustrated below:

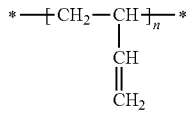

Along such lines, it may be appreciated that one particularly useful polybutadiene may include a polybutadiene that contains, by weight, about 60% trans-1,4; 20% cis-1,4 and 20% 1,2 vinyl structure, wherein the value of n in the above equations may be sufficient to provide a number average molecular weight (Mn) of between 1000-5000, including all values and increments therein. Furthermore, the polydiene polymer herein may be a substituted polydiene and include, e.g., a polyisoprene or other substituted polydiene components and/or polydiene copolymers (e.g., a polydiene repeating unit structure in combination with another comonomer unit).

The above referenced polydiene may be added in either a diisocyanate or diol form. Polybutadiene prepolymers are prepared by the reaction of a polybutadiene diol with a diisocyanate such as toluene diisocyanate (TDI). This prepolymer can be blended with other prepolymers in various proportions. Typical prepolymer/polybutadiene prepolymer blend ratios range from 95/5 to 60/40 parts by weight. In addition, a polydiene diol may be used. Particularly preferred is polybutadiene diol Poly Bd® R-45HTLO (Sartomer Company, Inc.), an α,ω-telechelic polybutadiene diol with a molecular weight, Mn, of approximately 2,800 and a microstructure of 20% cis-1,4-polybutadiene, 60% trans-1,4-polybutadiene and 20% 1,2-vinyl-polybutadiene.

Various isocyanate sources may be used. For ease of manufacture, a urethane prepolymer(s) is preferred such as a polyester or polycaprolactone polymer terminated with various diisocyanates such as toluene diisocyanate (TDI) or methyl diphenyl diisocyanate (MDI). For example, Versathane® A7QM (Air Products) which is a polyester type, and Vibrathane® 6060 (Chemtura Corp.) which is a polycaprolactone, can be used. Polycaprolactone urethane prepolymers, such as Vibrathane® 6060, are preferred because of their stable electrical resistivity with temperature and humidity changes.

Additional curatives may be added as needed to achieve any particularly desirable physical properties of the urethane elastomers. Curatives may comprise at least di-functionality to act as chain extenders, and tri-functionality to act as cross-linkers or to promote networking within the matrix, functional groups being generally defined as groups comprising active hydrogens, for example amines or hydroxyls. Exemplary curatives include; polycaprolactone polyols such as CAPA® (Solvay Caprolactones), polyether diols or triols, such as those sold by Perstorp Polyols, Inc. under the Polyol trade-name, Voranol® (Dow Chemical Co.), Poly-G®, Poly-Q® (Arch Chemical, Inc.) and Pluracol® (BASF), polyester diols such as Fomrez® (Witco Corp.), polydimethylsiloxane diols and diamines such as Silaplane® (Chisso Corp). Preferred curatives include Polyol 3611 (Perstorp Polyols, Inc.), a trifunctional polyether polyol, and triisopropanol amine (TIPA), which improves the hydrolytic stability of the urethane elastomers described herein.

An antioxidant can be added to the urethane. The antioxidant material may be, for example, aromatic amines, hindered phenols or a hydroperoxide decomposer such as phosphate or sulfide. Particularly preferred is the hindered phenol, 2,6-di-t-butyl-4-methylphenol (BHT).

In particular, the rollers herein may be sourced from a blend of the above referenced polydienes with a polyurethane resin and/or a copolymer of the polydiene with a urethane repeating unit segment. For example, the polybutadiene prepolymers may be prepared by the reaction of a polybutadiene diol (PBD), a hydroxyl terminated polybutadiene, with a diisocyanate, such as toluene diisocyanate (TDI). This PBD-TDI prepolymer can then be blended with a caprolactone prepolymer in various proportions. One suitable polybutadiene diol is Polybd® R45HT, Sartomer Company Inc. The blend of prepolymers may be cured with polyol curatives, such as Polyol 3611 (Perstop Polyols, Inc.) and triisopropanol amine (TIPA). Typical polycaprolactone/polybutadiene blend ratios may range from 95/5 parts by weight per hundred parts of total rubber which includes the polycaprolactone and the polybutadiene to 60/40 parts by weight, including all values and increments therein.

Accordingly, polybutadiene can be added in either prepolymer or diol form. The polycaprolactone urethane can be cured by using a combination of polybutadiene diol (such as Polybd® R-45HTLO with BHT, a product of Sartomer Company Inc.) with a trifunctional curative such as the Polyol 3611. Polyol 3611 is a polyether polyol with a functionality of 3. In this case, the polybutadiene diol acts as a polymer chain extender for the urethane. Typical weight ratios of the Polyol 3611 to the polybutadiene diol range from 1/0 up to 1/7 by weight, preferably 1/3 by weight. The polybd R-45HT polybutadiene has a number average molecular weight Mn, of 2800 and a microstructure of 20% ds-1,4-polybutadiene, 60% trans-1,4-polybutadiene and 20% 1,2-polybutadiene.

The polybutadiene prepolymer is a very highly resistive material. The addition of high levels of conductive additives in powder form such as copper (II) chloride or ferric chloride does not lower the electrical resistivity of this material. In contrast, addition of 0.1 parts by weight ferric chloride powder to one hundred parts by weight polycaprolactone urethane reduces the electrical resistivity from the $5\times10^{10}$ ohm-cm range to approximately $1.5\times10^{8}$ ohm-cm. Ferric chloride is not soluble in the polybutadiene prepolymer.

Ferric chloride may be added to the polybutadiene/polycaprolactone urethane blend to reduce the blend bulk resistivity to less than $1\times10^{9}$ ohm-cm. Typical concentrations of ferric chloride ($FeCl_3$) may range from 0.05-0.30 parts by weight per hundred in the overall composition, preferably 0.1-0.25 parts by weight per hundred in the overall composition, including all values and increments therein. Other conductive additives may include ferrous chloride ($FeCl_2$), calcium chloride ($CaCl_2$) and cobalt hexafluoroacetylacetonate.

The urethane formulation may then be cast into a mold around a central, metal shaft and then cured at approximately 100° C. for up to 16 hours using a combination of curing in a mold, demolding and postcuring in an oven to produce a roller. The roller is then ground to a selected dimension. This roller does not initially have a resistive layer on the surface. The resistive layer may be produced by baking the ground roll in air at an elevated temperature for some length of time. This baking procedure oxidizes the polybutadiene. As noted, the polybutadiene is highly unsaturated (60% trans 1,4; 20% cis 1,4 structure) which makes it very susceptible to oxidation. The presence of ferric chloride may serve to catalyze this oxidation process. A relatively high resistivity layer is not formed in the presence of copper chloride since copper chloride does not sufficiently catalyze the oxidation reaction to produce a relatively high resistance to the surface layer. As noted above, conductive additives that do catalyze this oxidation process include ferric chloride, calcium chloride and/or cobalt hexafluoroacetylacetonate.

Accordingly, the oxidation of polybutadiene in the presence of ferric chloride produces an electrically resistant surface layer. The thickness and electrical resistivity of this surface layer may be controlled by varying any one or more of: (a) the concentration of conductive additive (ferric chloride); (b) concentration of the diene polymer (e.g. polybutadiene); (c) the baking temperature; (d) the level of oxygen; and/or (e) the baking time.

The rollers noted above, containing a polydiene resin and conductive additive may now also specifically include an organic salt additive. Such organic salt may be introduced into the endless electrophotographic member by at least two different methods. First, the organic salt may be introduced into the reacting components, described above, that may be selected to formulate and provide a given roller composition. Accordingly, in this situation, the organic salt may be understood to be generally dispersed throughout the polymeric resin environment. In addition, one may expose and provide for the organic salt to migrate into the surface of the member (not prepared in the presence of such organic salt) wherein it may now be understood that the organic salt may be diffused into a selected portion of the polymeric resin environment. In either case, the organic salt may now be selected and introduced in an amount such that the roller may generally retain a desired level of surface electrical resistance at a nip location and/or reduce the tendency for nip banding, during the life, e.g., a given printer cartridge, which nip banding characteristics are described more fully below.

The organic salt additives may therefore initially include a metal salt which comprises a metal atom (M+) and one or more ligands (L)n that provides a neutralizing anionic charge, e.g., the metal salt may include a hydroxyl-aromatic acid having the following general structure:

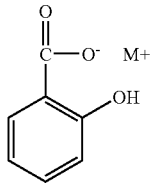

In the above, M may be preferably selected from zinc (Zn), while other metals that are contemplated herein may include Co, Mn, Ca, Zr, V, Al, Ce and/or Ba. Accordingly, the present invention contemplates the use of organic salts of the structure M+(L)n, wherein n is selected such that the number of ligands present may neutralize the cationic charge on the metal. Accordingly, the ligand (L) may therefore comprise any compound, e.g., an organic compound, that is capable of providing salt formation, and in the above structure, illustrating the metal salt of a hydroxyl-aromatic acid, the hydroxyl aromatic acid may serve as the ligand L. In addition, in the above, the hydroxyl functionality, while illustrated as ortho to the carboxylic acid functionality, is contemplated to be present at either the meta and/or para position, as generally illustrated below:

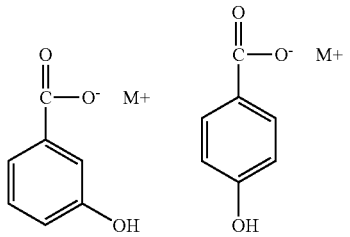

One particularly useful hydroxy-aromatic acid includes a dialkyl salicylate complex having the following general structure:

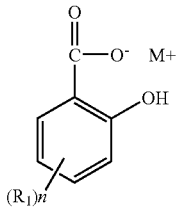

In the above, (R1)n may be at any available location on the aromatic ring (therefore n may have a value up to 3) and may comprise an alkyl group, such as a methyl, ethyl, butyl, isobutyl, tert-butyl, propyl and/or hexyl type functionality. In addition, M may again be preferably selected from Zn, while Co, Mn, Ca, Zr, V, Al, Ce and/or Ba are also contemplated herein and the appropriate number of anionic salicylate complexes may be coordinated to provide the appropriate salt. For example, an even more specific yet particularly useful additive is the zinc-3,5-di-tert-butylsalicylate complex illustrated below:

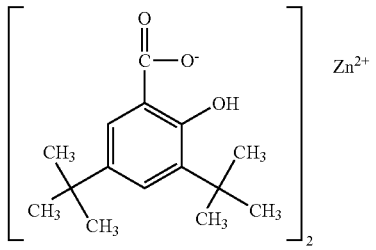

In addition, a still further useful organic salt that may retain surface electric resistance at the nip location and/or reduce nip banding tendency includes metallic salts of acetylacetonate, having the following general structure:

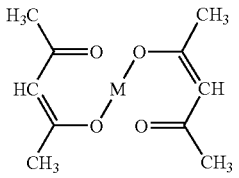

In the above, M may again be selected from Zn, while Co, Mn, Ca, Zr, V, Al, Ce and Ba are also contemplated herein. Accordingly, a particularly useful metallic salt of acetylacetonate includes zinc acetyl acetonoate having the following general structure:

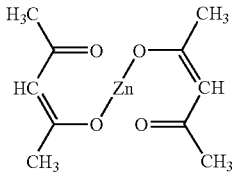

In addition, one may also utilize beta-diketonates, having the following general structure:

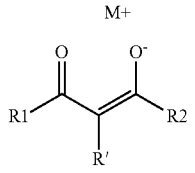

where M may again be selected from Zn, while Co, Mn, Ca, Zr, V, Al, Ce and Ba are also contemplated herein. In the above, R1, R1 and R2 may be an alkyl group, an aromatic group and/or a hydrogen atom. For example, R1 and R2 may be an alkyl (—$CH_3$) group, and R' may be a hydrogen atom.

Accordingly, it may now be appreciated that non-limiting examples of organic salts applicable herein that rely upon zinc include β-diketonate complexes of zinc(II) (i.e. zinc acetylacetonate, zinc hexafluoroacetylacetonate), salicylate complexes of zinc(II) (i.e. zinc salicylate, zinc 3,5-di-t-butylsalicylate), zinc acetate, zinc trifluoromethanesulfonate, zinc propionate, zinc dialkyldithiocarbamates (i.e. zinc dimethyldithiocarbamate, zinc diethyldithiocarbamate, zinc di-n-butyldithiocarbamate), zinc stearate, and zinc naphthenate.

As noted above, there are at least two methods available to incorporate the above referenced organic salts. First, one may combine such organic salts [e.g., the salts of zinc(II)] during formulation and preparation of the roller, as noted above. For example, when formulating the above referenced polyurethane resin systems containing the polydiene component (e.g. polybutadiene) one may add either the dialkyl salicylate complex and/or the metallic salt of acetylacetonate in the overall composition. In such situation, the concentration of the organic salt may be influenced by the solubility and/or ability to disperse the organic salt in a given roller composition. Along such lines, the organic salt, when added directly to the overall composition, may be present in an amount of 100-5,000 ppm. More specifically, in the case of zinc-3,5-di-tert-butylsalicylate (ZnDTBSA), one may employ about 400-4,000 ppm. In the case of zinc acetyl acetonoate, one may employ 200-1,000 ppm.

In addition, as also noted above, the organic salts herein may be configured such that they are arranged to diffuse or migrate into the surface of the roller, either prior to or after the oxidative baking procedures noted herein. For example, the organic salts of zinc(II) may be introduced into the roller according to any one or more of the following protocols described below.

The roller containing the polydiene resin and conductive additive (e.g. $FeCl_3$) may be positioned with an electrophotographic printer cartridge including toner containing the organic salt (e.g. zinc-3,5-di-tert-butyl salicylate and/or the metallic salt of acetylacetonate) wherein the additive may be present in the toner at a level of 1.0-10% by weight. The roller may also be electrically biased to a level of −500 to −750 volts, including all values and increments therein. For example, one may bias the roller at a level of about −600 to −650 volts. The toner may specifically include a toner formulation containing a pigment (e.g. carbon black) and a polymeric resin, such as a polystyrene-polyacrylate copolymer. The printer cartridge containing such a toner/organometallic mixture may then be operated for a period of 10-60 minutes, including all values and increments therein.

The roller containing the polydiene resin conductive additive may be exposed to a solvent containing the organic salt wherein the salt is present in the solvent. A suitable carrier solvent may be an organic alcohol, such as methanol, ethanol and/or isopropyl alcohol. The organic salts may be present in the carrier solvent at a level of 0.1 to 1.0% by weight.

The roller containing the polydiene resin and conductive additive may be exposed to solid particulate of the organic salt, wherein the salt is presented to the roller surface at an average particle size of 1-50 microns. For example, one may expose the surface of the roller to a selected quantity of organic salt additive, e.g. 5-250 mg for a roller having a roller surface area of 100-200 $cm^2$. Unless otherwise noted, the exemplary roller utilized herein (FIGS. 1-5) had an available surface area of 146 $cm^2$.

Once the roller is coated with solid particulate of the organic salts, as noted above, one may then heat the roller for a period of time prior to the resistive baking or as part of the oxidative baking process. Accordingly, this heating step may proceed for a period of 1-12 hours at a temperature of between 75-125° C. It may also include any value or increment of time and temperature in this range, e.g., 100-120° C. for a period of 8.0 hours.

Additionally, the roller exposed to solid particulate may also be exposed to vapors of an organic solvent, such as an organic alcohol (e.g. methanol) which solvent vapors may then facilitate migration of the organic salt into the roller surface. In addition, in lieu of organic solvent vapors, one may utilize water vapor. However, it is worth noting that if water vapor is selected, it may be useful to consider the water level of the roller. That is, rollers with relatively high water levels (0.5-10.0% by weight) were found to be relatively difficult to achieve migration of the organic salts of zinc(II). Accordingly, if water vapor is employed, it may be useful to do so with rollers having a water content of less than or equal to 0.50% by weight, for example, 0.01-0.50% by weight, including all values and increments therein.

Rollers produced as noted above were then evaluated for, among other things, electrical properties, nip banding and overall printing performance. In addition, the rollers were evaluated to identify the level of organic salt that may be present in the outer roller region.

It is therefore worth noting that nip banding herein was evaluated by a consideration of print quality. That is, print quality was tested for exemplary rollers used as developer rollers in a Lexmark International T642 laser printer. Rollers were installed in the corresponding toner cartridges and aged at 47° C. for two weeks followed by 24 hours at lab ambient conditions. Sample pages at all darkness settings were printed at lab ambient conditions. Banding performance was rated on a scale of 3 to 0, with a 3 rating being the worst, indicating severe banding observed at all darkness settings, 2 indicating moderate banding only at the highest darkness settings, 1 indicating only very faint banding and 0 indicating that no visible banding was observed. See again, FIG. 1, which identifies the amount of Zn-3,5-ditertbutylsalicylate in a roller (overall mg) for a roll with 146 $cm^2$ surface area and nip banding performance.

With respect to electrophotographic members (e.g., developer rollers) that include the organic salt dispersed within the polymeric resin environment, the electrical properties are such that the roller may have a core resistivity of less than or equal to $1\times10^9$ ohm-cm, preferably less than $3\times10^8$ ohm-cm, at 60° F. and 20% relative humidity (RH). In addition, the rollers may indicate a roll resistance of about $5\times10^7$ to about $5\times10^8$ ohm, preferably between $8\times10^7$ to about $3\times10^8$ ohm for a contact area of 18.5 $cm^2$, along with a surface layer resistivity of $5\times10^9$ to $2\times10^{12}$ ohm-cm, preferably between $5\times10^{10}$ and $1\times10^{12}$ ohm-cm at 60° F. and 20% relative humidity (RH) and a surface layer thickness of about 30-300 microns at 60° F. and 20% relative humidity (RH). The time constant may be about 5-2000 milliseconds, preferably about 100-500 milliseconds, at 60° F. and 20% relative humidity (RH).

With respect to electrophotographic members (e.g. developer rollers) that include the organic salt diffused into the rollers, the electric properties are such that the roller may have a core resistivity of less than or equal to $1\times10^9$ ohm-cm, preferably less than $3\times10^8$ ohm-cm, at 60° F. and 20% relative humidity (RH). In addition, the rollers may indicate a surface layer resistivity of $5\times10^9$ to $2\times10^{12}$ ohm-cm, preferably $6\times10^{10}$ ohm-cm at 60° F. and 20% relative humidity (RH) and a surface layer thickness of about 30-300 microns at 60° F. and 20% relative humidity (RH), preferably about 150-250 microns at 60° F. and 20% relative humidity (RH). The time constant may be about 5-2000 milliseconds, preferably about 50 milliseconds, at 60° F. and 20% relative humidity (RH).

As alluded to earlier, the above referenced surface layer resistivity values, in the presence of the organic salt, may now be maintained at the nip location for the lifetime of a given electrophotographic member, e.g., the lifetime of a developer roller within a given printer cartridge. In that regard, the surface layer resistivity values reported above may be maintained on a developer roller having a nip location for up to and include the printing of about 75,000 pages (e.g., an 8.5 inch by 11.0 inch page) at 5.0% coverage, including all values and increments between 1-75,000 pages at 5.0% converge.

The organic salt may be placed on the roller at a specific level of between about 20 mg to 120 mg, although, as noted above, it is contemplated that the surface of the roller may be exposed to a level of 5 mg to 250 mg. In addition, as noted, the organic salt additive may then be made to present in the roller at a level between 20 mg to about 100 mg. However, it is contemplated herein that the organic salt additive may be present in the roller at a level of between 5 to 200 mg, including all values and increments therein. These weights are for a roll with an available surface area of 146 $cm^2$.

FIG. 2 identifies the use of zinc-di-tert-butylsalicylate in an electrophotographic member, containing a polydiene resistive surface layer, according to the present disclosure. In FIG. 2, the columns identified as "Depth (μm) From Surface" represent the layer between the surface down to the indicated depth of 100 μm, or 200 μm, or 300 μm. For example, the second row of data in FIG. 2 would give the concentrations for the layer from 100 μm below the surface to 200 μm below the surface. It may be noted that there is also some concentration of the organic salt below 300 μm. As can therefore be observed, the metallic element of the organic salt (in this case Zn) may be configured to be present in the roller in 100 μm layers from the surface. It is also worth noting that such condition is provided in the electrophotographic member prior to use by a consumer, so that the avoidance of nip banding, as noted herein, is immediately present. For example, the condition may be achieved in a developer roller prior the roller having printed.

The first layer from the surface, down to a level of about 100 μm, may be configured to contain about 300 to 7000 ppm of the metallic element of the organic salt. The second layer down extends from about 100 μm to about 200 μm may contain about 50 ppm to 2000 ppm. The third layer down from about 200 μm to about 300 μm may provide about 0-1000 ppm. Accordingly, it can be appreciated that the organic salt additive may be present in a concentration gradient from the surface of a given roller, wherein the concentration gradient (i.e., the presence of the organic salt) is configured to generally decrease in concentration from a first 100 μm layer through to a second 100 μm layer and finally to a third 100 μm layer.

A roller is typically painted with conductive carbon paint in a 8 mm strip down the roll. Alternatively, a 8 mm strip of conductive carbon tape is placed down the roll. This creates a surface area of 18.5 $cm^2$. A circuit is made by making electrical contact with the painted surface and the roller shaft. The DC resistivity (resistance) of the roll at 100 V, the AC resistance of the roll at 1 KHZ, and the time constant are measured. The time constant is measured by applying a 100 volt bias to the roll, removing the voltage and measuring the time for voltage on the roll to decay to 1/e (37%) of its original value. This time constant is related to the thickness and resistivity of the surface layer on the roll. The roller is modeled as two parallel RC circuits in series. One RC circuit represents the core and the second represents the resistive layer. Based on this model, the following equations apply:

$$\text{Tau}=R*C=\text{rho}_c*Kc*\text{epsilon}_o$$

$$\text{rho}_c=\text{tau}/(Kc*\text{epsilon}_o)$$

$$T=R*A/\text{rho}_c$$

where tau=time constant $\text{rho}_c$=surface layer resistivity

C=capacitance

Kc=dielectric constant of coating $\text{epsilon}_o=8.85\times10^{-12}$ $\text{Coulombs}^2/\text{Newtons}\times\text{Meters}^2$ (permittivity of free space)

T=thickness of resistive layer

R=roll DC resistance

A=measurement surface area of roll

Therefore, the resistive layer thickness and resistivity can be calculated from the time constant and DC resistance measurements. The dielectric constant of the coating is assumed to be 10, a typical value for polyurethane rubber.

Increasing the polybutadiene level increases the resistivity at the surface. Increasing the time and temperature of baking increases both the thickness from the surface that the increased resistivity may be found and the surface electrical resistivity. Accordingly, rollers have been prepared herein, utilizing a polyurethane containing a polydiene copolymer segment (e.g. polybutadiene), along with conductive additives (e.g. ferric chloride, ferrous chloride, calcium chloride) and the organic salt additive (e.g., zinc-3,5-di-tertbutyl salicylate and/or zinc acetylacetonate). As noted above, the organic salt additive may be dispersed through-out the roller, the roller surface may be exposed to the organic salt, or one may prepare a roller with the organic salt dispersed throughout and also expose the surface to the organic salt to provide the desired surface resistivity ($5\times10^9$ ohm-cm to $2\times10^{12}$ ohm-cm at 60° F. and 20% relative humidity at a nip location). In addition, the time constant of such rollers was about 4 to 1800 ms.

Print test results of oxidized polybutadiene rolls containing antioxidant indicate they have excellent print performance across a wide speed range. Their performance mimics that of a conductive roll coated in a separate process with a resistive material.

Nip Banding

As noted above, nip banding may be understood as the formation of relatively dark regions on the printed media, due to the formation of a nip between, e.g., the developer roller and a doctor blade, or between the developer roller and toner adder roller, when in a given printer cartridge. Nip banding therefore amounts to some change in electrical properties (e.g., increase in resistance) at the nip region relative to the non-nip area, which is believed due to contact with the roller surface (again, contact of, for example, a doctor blade or toner adder roller with a developer roller surface). It is observed under those conditions where one employs an oxidized polybutadiene roller, containing the above referenced additive, nip banding was reduced and surface resistance remained relatively constant.

Along such lines, attention is first directed to FIG. 1 which illustrates the reduction in nip banding that was observed for rollers prepared herein by the method of applying the organic salt to the surface and allowing for diffusion. That is, the incorporation of zinc-3,5-ditertbutyl salicylate in the roller by diffusion reduces the observed amount of nip banding that typically occurs in a developer roller in an electrophotographic printer.

Electrical Properties

Figure 3:
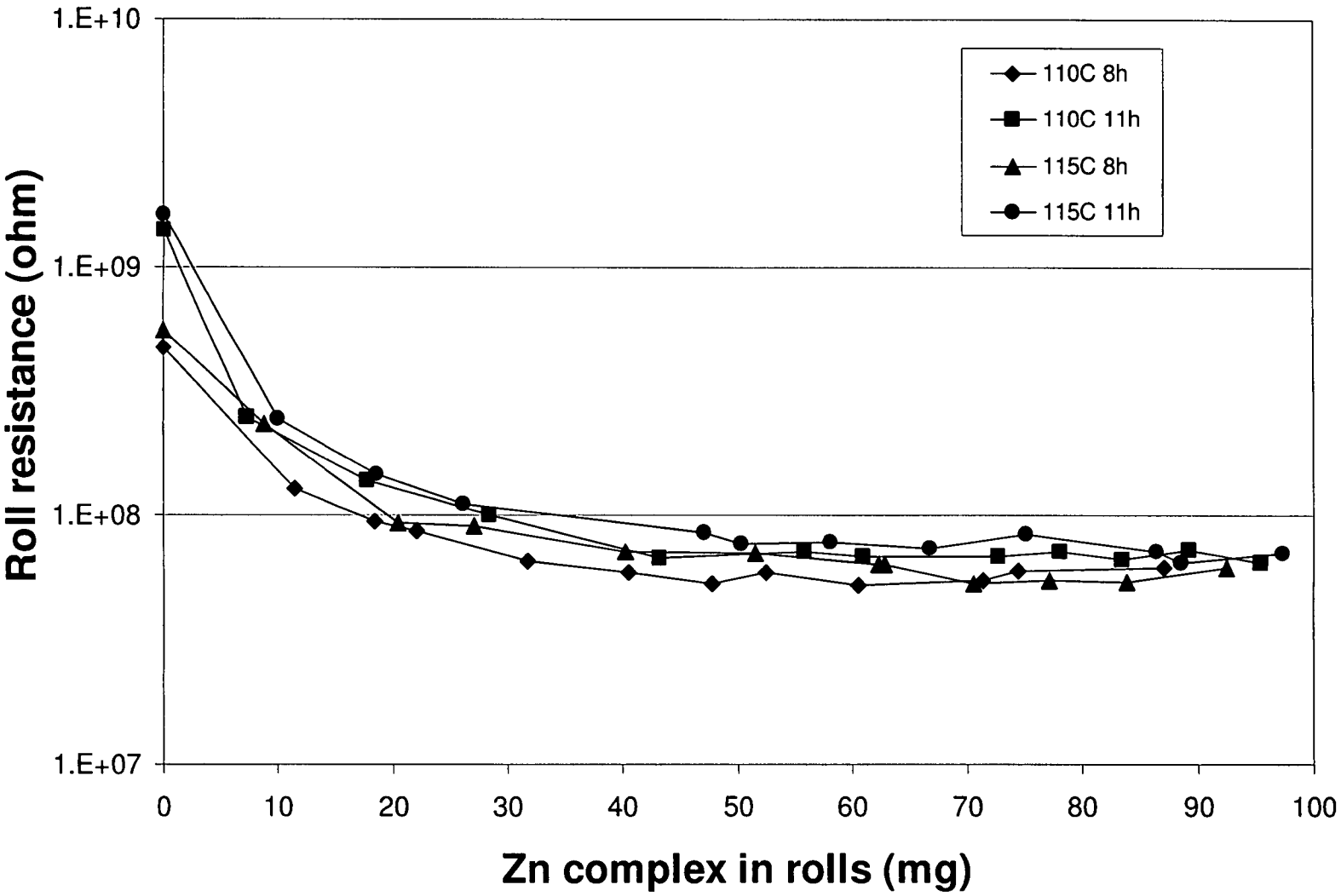
FIG. 3 is a graph illustrating the use of indicated amounts of the zinc complex (zinc-3,5-di-tert-butylsalicylate) with an oxidized urethane roller containing polybutadiene and the corresponding roller resistance (ohms) that is achieved at the indicated times (h=hours) and temperature (degrees C.) of baking.
Figure 4:
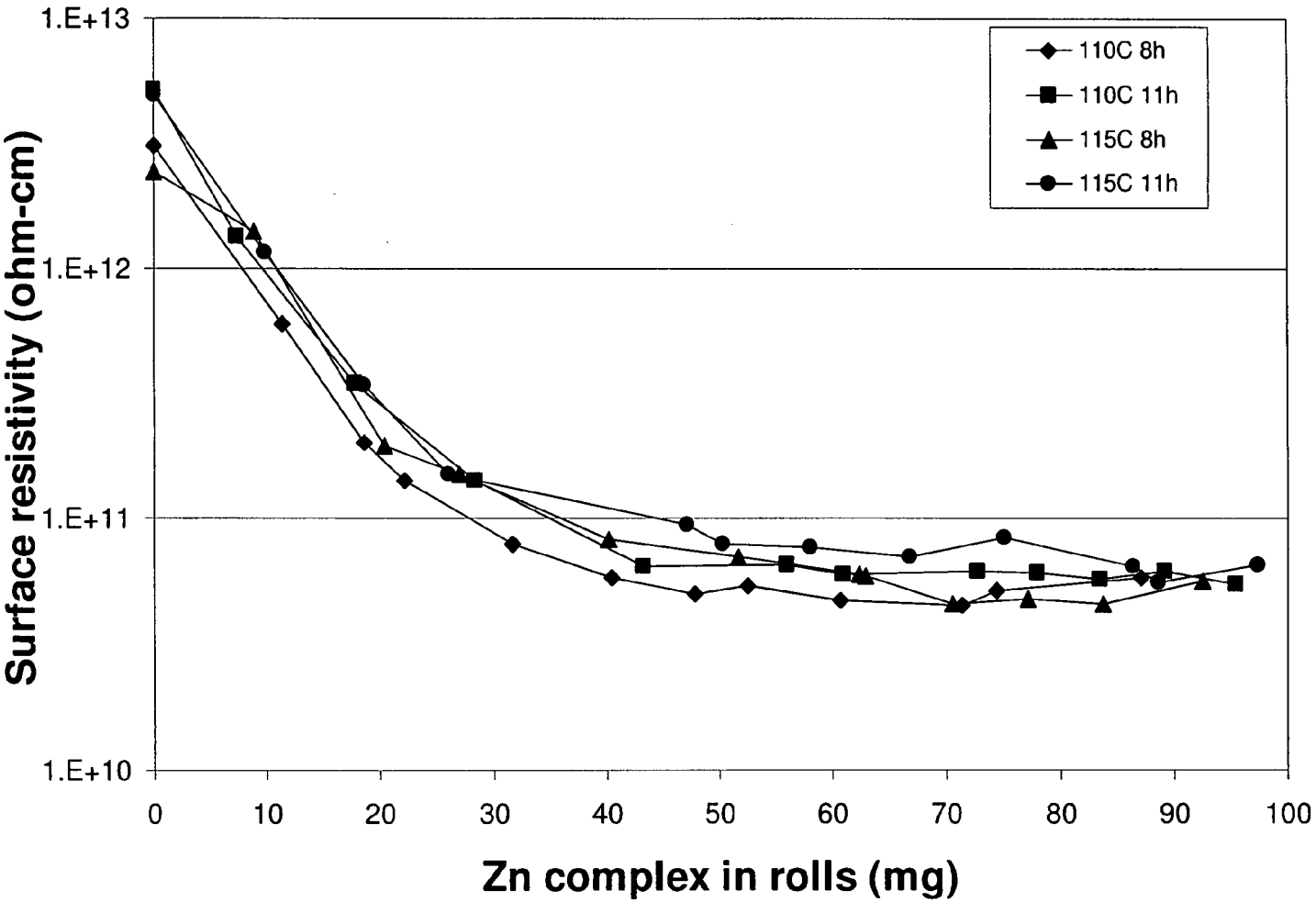
FIG. 4 is a graph illustrating the use of the indicated amounts of the zinc complex (zinc-3,5-di-tert-butylsalicylate) with an oxidized urethane roller containing polybutadiene and the corresponding surface resistivity (ohm-cm) that is achieved at the indicated times (h=hours) and temperature (degrees C.) of baking.
Figure 5:
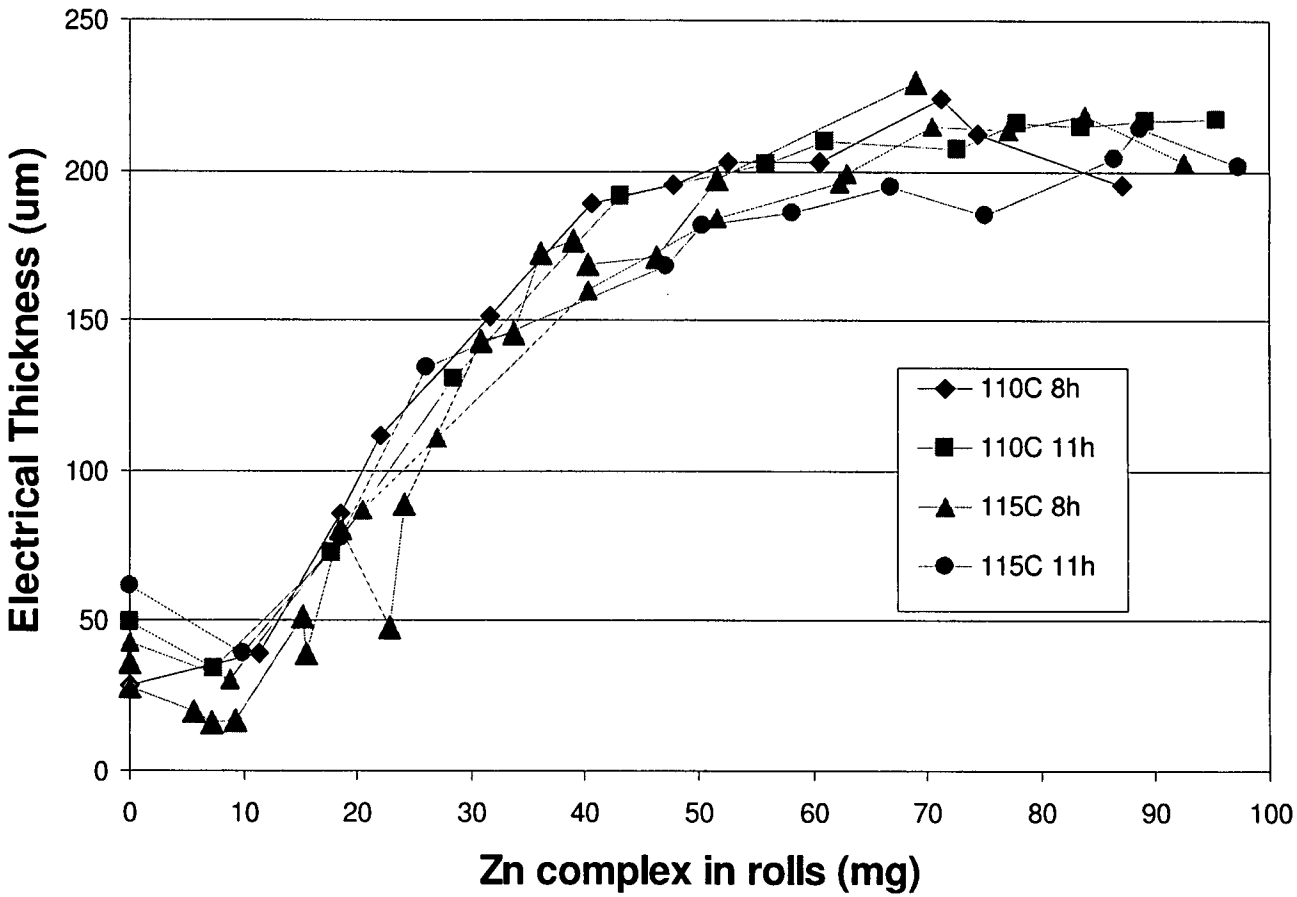
FIG. 5 is a graph illustrating the use of the indicated amounts of zinc complex (zinc-3,5-di-tert-butylsalicylate) with an oxidized urethane roller containing polybutadiene and the corresponding electrical thickness (micrometers) that is achieved at the indicated times (h=hours) and temperature (degrees C.) of baking.

FIG. 3 illustrates the roller resistance (ohms) for rollers surface treated with an organic salt as noted herein, versus the amount of organic salt in the roller (ZnDTBSA in mg) followed by baking at the indicated times and temperatures. As can be seen, the overall roller resistance in ohms is seen fall within the range of about $1\times10^{7.5}$ ohms to about $1\times10^{8.5}$ ohms. Attention is next directed to FIG. 4 which illustrates that the surface resistivity of the rollers herein surface treated with various amount of the organic salt additive (ZnDTBSA in mg) may specifically fall in the range of $2\times10^{10}$ ohms to $1\times10^{11.5}$. Furthermore, FIG. 5 confirms that the electrical thickness of the rollers containing the organic salt additive (ZnDTBSA in mg diffused therein) may specifically fall in the range of between about 50-250 μm. Electrical thickness may be understood as the thickness of the resistive layer which is calculated from the time constant test given above.

Further to above, the following discussion relates to that situation where the organic salt may be introduced during roller preparation and therefore dispersed through-out the roller. Specifically, the ingredients, as set forth in the examples below, are mixed to form polyurethane elastomers. The polyurethanes were prepared below using a 0.95 stoichiometric ratio of —OH to —NCO. Vibrathane® 6060 polycaprolactone/TDI prepolymer (Chemtura Corp.) and polybutadiene (Poly Bd® R-45HTLO with BHT, Sartomer Company, Inc.) were independently warmed to 75° C. and degassed prior to mixing. Trifunctional curatives, Polyol 3611 (Perstorp Polyols, Inc.) and triisopropanol amine (TIPA), ferric chloride, and the exemplary zinc(II) salts are then premixed, degassed, and added as a single solution at 40° C. The mixture is injected into cylindrical roll molds about a conductive metal shaft, and cured in the mold at 100° C. for approximately 30 minutes. Rolls are then ground to the required functional dimensions. The resistive layer is produced on the roll surfaces via an oxidative baking process in which each sample is baked in air at 100-110° C. for 8-12 hours. The formulations for the examples of this preparation are listed in Table 1, with ingredient ratios listed as weight % solids. Comparative example C1 does not contain a zinc(II) additive and is included for comparative purposes.

TABLE 1

Roller Formulations

| | Example # | | | | | | |
|---|---|---|---|---|---|---|---|
| | C1 | 1 | 2 | 3 | 4 | 5 | 6 |
| Vibrathane ® 6060 | 82.87 | 82.53 | 82.66 | 82.38 | 82.30 | 82.91 | 82.73 |
| Polybutadiene + BHT | 12.33 | 12.33 | 12.33 | 12.33 | 12.33 | 12.33 | 12.33 |
| Polyol 3611 | 4.53 | 4.89 | 4.71 | 4.79 | 4.79 | 4.47 | 4.62 |
| TIPA | 0.10 | 0.10 | 0.10 | 0.10 | 0.10 | 0.10 | 0.10 |
| FeCl3 | 0.17 | 0.14 | 0.14 | 0.14 | 0.14 | 0.14 | 0.14 |
| Zinc acetylacetonate | — | 0.04 | 0.06 | — | — | — | — |
| Zinc 3,5-di-t-butylsalicylate | — | — | — | 0.26 | 0.34 | — | — |
| Zinc acetate | — | — | — | — | — | 0.04 | — |
| Zinc trifluoro-methanesulfonate | — | — | — | — | — | — | 0.08 |

As noted herein, the rollers may be characterized by a variety of electrical techniques. As alluded to above, once again, with respect to the roller formulations identified in Table 1, a conductive media such as conductive carbon paint or tape is applied in a thin stripe (~8 mm) down the length of the roll. Attaching electrical contacts to the surface stripe and roller shaft completes a circuit. The direct current resistance (R) of the roll at 100 volts, the time constant (τ), and the alternating current resistance of the roll at 1 kHz are measured. The time constant is measured by applying a 100 volt bias to the sample, removing the voltage, then measuring the time for the voltage on the roll to decay to 1/e (~37%) of its original value. The measured resistance and time constant are used to calculate roll resistivity ($Rho_c$) and thickness ($T_c$) of the oxidized surface layer on the sample. The electrical properties of the elastomers are modeled as two parallel RC circuits in series. One RC circuit represents the core and the second represents the resistive surface layer. Roll resistance (R), time constant (τ), surface layer resistivity ($Rho_c$), surface layer thickness ($T_c$), and bulk resistivity ($Rho_b$) for the formulations were measured at 60° F. and 20% RH and the results are reported in Table 2.

TABLE 2

Roller Electrical Properties

| | Zinc (ppm) | R (Ohm) | τ (sec) | $Rho_c$ (Ohm-cm) | Tc (μm) | $Rho_b$ (Ohm-cm) |
|---|---|---|---|---|---|---|
| C1 | 0 | $5\times10^{8}$ | 2 | $2\times10^{12}$ | 35 | $2\times10^{08}$ |
| 1 | 100 | $1.03\times10^{8}$ | 0.307 | $3.47\times10^{11}$ | 61 | $1.86\times10^{08}$ |
| 2 | 150 | $1.16\times10^{8}$ | 0.549 | $6.20\times10^{11}$ | 38 | $2.70\times10^{08}$ |
| 3 | 300 | $8.57\times10^{7}$ | 0.243 | $2.74\times10^{11}$ | 59 | $2.50\times10^{08}$ |
| 4 | 400 | $1.21\times10^{8}$ | 0.059 | $6.64\times10^{10}$ | 336 | $6.27\times10^{08}$ |
| 5 | 150 | $1.84\times10^{8}$ | 0.311 | $3.51\times10^{11}$ | 97 | $2.71\times10^{08}$ |
| 6 | 150 | $2.71\times10^{7}$ | 0.116 | $1.30\times10^{11}$ | 39 | $2.25\times10^{08}$ |

Print quality was tested for exemplary rollers used as developer rolls in a Lexmark International T642 laser printer. Rollers were installed in the corresponding toner cartridges and aged at 47° C. for two weeks followed by 24 hours at lab ambient conditions. Sample pages at all darkness settings were printed at lab ambient conditions. Banding performance was again rated on a scale of 3 to 0, with a 3 rating being the worst, indicating severe banding observed at all darkness settings, 2 indicating moderate banding observed only at the highest darkness settings, 1 indicating only very faint banding, and 0 indicating that no visible banding was seen. Results of this test can be found in Table 3.

TABLE 3

| Roll Banding Performance | | |
|---|---|---|
| | Zinc (ppm) | Banding Rating |
| C1 | 0 | 3 |
| 1 | 100 | 1 |
| 2 | 150 | 0 |

The examples above demonstrate that it is possible to incorporate a variety of organic zinc(II) salts through-out a urethane roller formulation and achieve acceptable electrical properties and improved print performance especially in relation to "nip-banding".

Finally, it should be noted that the rollers of the present disclosure may be particularly useful when applied to toner particles that are prepared by chemical methods, and in particular via an emulsion aggregation procedure, which generally provides resin, colorant and other additives. A chemical method herein may be understood as a method that provides a given toner particle size without the need for mechanical pulverization. More specifically, the toner particles may be prepared via the steps of initially preparing a polymer latex from unsaturated olefin type monomers, in the presence of an ionic type surfactant, such as an anionic surfactant having terminal carboxylate (—$COO^-$) functionality. The polymer latex so formed may be prepared at a desired molecular weight distribution (MWD=Mw/Mn) and may, e.g., contain both relatively low and relatively high molecular weight fractions to thereby provide a relatively bimodal distribution of molecular weights. Pigments may then be milled in water along with a surfactant that has the same ionic charge as that employed for the polymer latex. Release agent (e.g. a wax or mixture of waxes) may also be prepared in the presence of a surfactant that assumes the same ionic charge as the surfactant employed in the polymer latex. Optionally, one may include a charge control agent.

The polymer latex, pigment latex and wax latex may then be mixed and the pH adjusted to cause flocculation. For example, in the case of anionic surfactants, acid may be added to adjust pH to neutrality. Flocculation therefore may result in the formation of a gel where an aggregated mixture may be formed with particles of about 1-2 μm in size. Such mixture may then be heated to cause a drop in viscosity and the gel may collapse and relative loose (larger) aggregates, from about 1-25 μm, may be formed, including all values and ranges therein. For example, the aggregates may have a particle size between 3 μm to about 15 μm, or between about 5 μm to about 10 μm. In addition, the process may be configured such that at least about 80-99% of the particles fall within such size ranges, including all values and increments therein. Base may then be added to increase the pH and reionize the surfactant or one may add additional anionic surfactants. The temperature may then be raised to bring about coalescence of the particles, which then may be washed and dried. Coalescence is reference to fusion of all components.

The foregoing description of several methods and an embodiment of the invention have been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method for forming an electrophotographic roller comprising:

molding a polyurethane containing a polydiene, and an electrically conductive filler into a roller;

baking the roller to oxidize the polydiene; and exposing an outer surface of the roller to an organic salt, wherein the organic salt diffuses from the outer surface of the roller and into the roller;

wherein the roller being formed includes a resistive surface layer having a resistivity of between $5\times10^9$ –$2\times10^{12}$ ohm-cm at 60° F. and 20% relative humidity, and a core layer having a resistivity of less than or equal to $1\times10^9$ ohm-cm at 60° F. and 20% relative humidity.

2. The method of claim 1, wherein the exposing of the outer surface of the roller includes exposing the outer surface of the roller to solid particles of the organic salt, wherein the solid particles have an average particle size of 1-50 microns.

3. The method of claim 2, further comprising exposing the roller to vapors of an organic solvent to facilitate migration of the organic salt into the roller.

4. The method of claim 3, wherein the organic solvent is an organic alcohol including methanol.

5. The method of claim 1, wherein the exposing of the outer surface of the roller includes positioning the roller in an electrophotographic printer cartridge including toner containing the organic salt.

6. The method of claim 5, wherein the organic salt is present in the toner at a level of about 1.0-10% by weight.

7. The method of claim 5, further including applying an electrical bias to the roller.

8. The method of claim 1, wherein the exposing of the outer surface of the roller comprises exposing the roller to a solvent containing the organic salt.

9. The method of claim 8, wherein the solvent is an organic alcohol including methanol, ethanol, isopropyl alcohol or combinations thereof, and wherein the organic salt is present in the solvent at a level of about 0.1-1.0% by weight.

10. The method of claim 1, wherein the organic salt comprises a hydroxyl-aromatic acid having the following general structure:

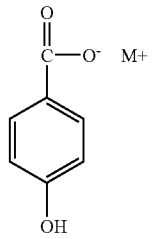

where M is selected from the group consisting of Zn, Co, Mn, Ca, Zr, V, Al, Ce and Ba.

11. The method of claim 1, wherein the organic salt comprises a dialkyl salicylate complex having the following structure:

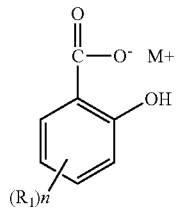

where $R_1$ is an alkyl group, n has a value of 0-3, and M is selected from the group consisting of Zn, Co, Mn, Ca, Zr, V, Ai, Ce and Ba.

12. The method of claim 1, wherein the organic salt comprises a metallic salt of acetylacetonate having the following structure:

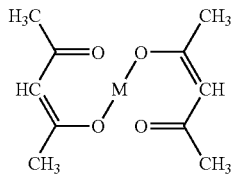

where M is selected from the group consisting of Zn, Co, Mn, Ca, Zr, V, Al, Ce and Ba.

13. The method of claim 1, wherein the organic salt comprises a zinc salt of acetylacetonat.

14. The method of claim 1, wherein the organic salt comprises a metallic salt of beta-diketonate, having the following general structure:

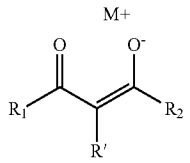

where M is selected from the group consisting of Zn, Co, Mn, Ca, Zr, V, Al, Ce and Ba and wherein $R_1$, R' and $R_2$ is selected from the group consisting of alkyl group, aromatic group and/or a hydrogen atom.

15. The method of claim 1, wherein the organic salt comprises a salt of the structure $Zn^{+2}(L)n$ wherein L is an anionic ligand and n is selected such that the number of ligands present neutralize the charge on the zinc.

16. The method of claim 1, wherein the exposing of the outer surface of the roller to the organic salt is performed prior to the baking of the roller to oxidize the polydiene.

17. The method of claim 1, wherein the exposing of the outer surface of the roller to the organic salt is performed after the baking of the roller to oxidize the polydiene.

18. An electrophotographic roller comprising:

a polyurethane containing a polydiene;

an electrically conductive filler; and an organic salt diffused from an outer surface of the roller and into the roller, wherein the roller includes an oxidized resistive surface layer having a resistivity of $5\times10^9$ ohm-cm to $2\times10^{12}$ ohm-cm at 60° F. and 20% relative humidity, and a core layer having a resistivity of less than or equal to $1\times10^9$ ohm-cm at 60° F. and 20% relative humidity.

19. The electrophotographic roller of claim 18, wherein the roller has a first layer measured from the outer surface down to a roller thickness of about 100 microns, a second layer measured from the roller thickness of about 100 microns from the outer surface down to a roller thickness of about 200 microns from the outer surface, and a third layer measured from the roller thickness of about 200 microns from the outer surface down to a roller thickness of about 300 microns from the outer surface, and wherein the organic salt is present in the roller at a decreasing concentration by weight from the first layer to the second layer and to the third layer.

20. The electrophotographic roller of claim 19, wherein the organic salt includes a metallic element, the metallic element is present in: (a) the first layer at a level of 300-7000 ppm; (b) the second layer at a level of 50-2000 ppm; and (c) the third layer at a level of 0-1000 ppm.

21. The electrophotographic roller of claim 18, wherein the resistive surface layer has a resistivity of $2\times10^{10}$ to $1\times10^{11}$ ohm-cm at 60° F. and 20% relative humidity.

22. The electrophotographic roller of claim 18, wherein the oxidized resistive surface layer has a thickness of 30-300 microns.

23. The electrophotographic roller of claim 18, wherein the organic salt comprises a hydroxyl-aromatic acid having the following structure:

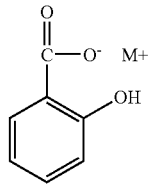

where M is selected from the group consisting of Zn, Co, Mn, Ca, Zr, V, Al, Ce and Ba.

24. The electrophotographic roller of claim 18, wherein the organic salt comprises a hydroxyl-aromatic acid having the following structure:

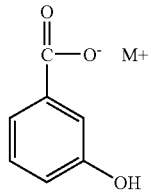

where M is selected from the group consisting of Zn, Co, Mn, Ca, Zr, V, Al, Ce and Ba.

25. The electrophotographic roller of claim 18, wherein the organic salt comprises a hydroxyl-aromatic acid having the following structure:

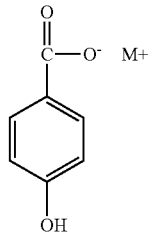

where M is selected from the group consisting of Zn, Co, Mn, Ca, Zr, V, Al, Ce and Ba.

26. The electrophotographic roller of claim 18, wherein the organic salt comprises a dialkyl salicylate complex having the following structure:

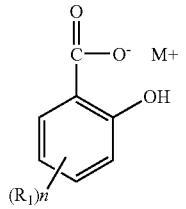

where $R_1$ is an alkyl group, n has a value of 0-3, and M is selected from the group consisting of Zn, Co, Mn, Ca, Zr, V, Ai, Ce and Ba.

27. The electrophotographic roller of claim 18, wherein the organic salt comprises zinc-3, 5-di-tert-butylsalicylate complex having the following structure:

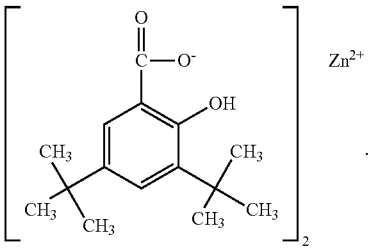

28. The electrophotographic roller of claim 18, wherein the organic salt comprises a metallic salt of acetylacetonate having the following structure:

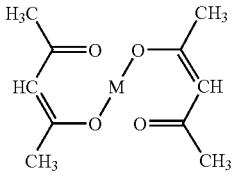

where M is selected from the group consisting of Zn, Co, Mn, Ca, Zr, V, Al, Ce and Ba.

29. The electrophotographic roller of claim 18, wherein the organic salt comprises a metallic salt of beta-diketonate, having the following general structure:

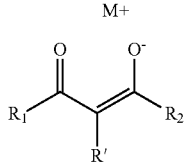

where M is selected from the group consisting of Zn, Co, Mn, Ca, Zr, V, Al, Ce and Ba and wherein $R_1$, R' and $R_2$ selected from the group consisting of alkyl group, aromatic group and/or a hydrogen atom.

30. The electrophotographic roller of claim 18, wherein the roller is a developer roller for an electrophotographic printer.

31. The electrophotographic roller of claim 18, wherein the roller is positioned in a printer cartridge.

32. The electrophotographic roller of claim 18, wherein the roller is positioned in an electrophotographic printer.

33. The electrophotographic roller of claim 18, wherein the organic salt comprises a salt of the structure $Zn^{+2}(L)n$ wherein L is an anionic ligand and n is selected such that the number of ligands present neutralize the charge on the zinc.

34. The electrophotographic roller of claim 18, wherein the roller is a developer roller having a nip location, and the surface layer resistivity is maintained at the nip location during printing of up to 75,000 pages.

* * * * *